United States Patent [19]

Jonqueres

[11] 4,147,437

[45] Apr. 3, 1979

[54] MIXER BLADE

[75] Inventor: Pierre Jonqueres, Epinay sur Orge, France

[73] Assignee: Procedes SEM, Cachan, France

[21] Appl. No.: 690,933

[22] Filed: May 28, 1976

[30] Foreign Application Priority Data

Jun. 4, 1975 [FR] France ..... 75 17429

[51] Int. Cl.[2] ..... B01F 7/22

[52] U.S. Cl. ..... 366/343; 366/330; 416/243

[58] Field of Search ..... 259/107, 108; 416/200 R, 223 R, 243; 366/343, 330

[56] References Cited

U.S. PATENT DOCUMENTS

| | | | |
|---|---|---|---|
| D. 141,589 | 6/1945 | Logsdon | 416/223 |
| 2,111,178 | 3/1938 | Crumback | 416/200 |
| 2,585,255 | 2/1952 | Kochner | 259/108 |
| 2,964,301 | 12/1960 | Bosse | 259/107 |
| 2,974,728 | 3/1961 | Culp | 416/223 |
| 3,135,499 | 6/1964 | Brown | 259/108 |
| 3,172,645 | 3/1965 | Price | 259/107 |
| 3,904,714 | 9/1975 | Rooney | 259/108 |

*Primary Examiner*—Robert W. Jenkins

*Attorney, Agent, or Firm*—Wenderoth, Lind & Ponack

[57] ABSTRACT

An impeller for producing a stirring action within a fluid medium contained in a vessel includes blades, each blade being shaped to produce a variation in the lift coefficient of the impeller from the rotational axis thereof to the blade tip, in order to provide a centrifugal or centripetal component, as case may be, of the outflaring or reduction imparted to the impeller blowing cone.

6 Claims, 19 Drawing Figures e
i
f
g
k
k1
m
m1
c
o
o'

MIXER BLADE

BACKGROUND OF THE INVENTION

The present invention relates to improvements in or relating to propellers, now more generally referred to as "impellers", of the type designed for producing a turbulent motion within a gaseous, liquid or other medium, or a medium having a more or less pronounced consistency, in order to effect in such medium the stirring of a mixture, an aeration, a mixing or dispersive action. However, this enumeration should not be construed as limiting the scope of the present invention.

As a rule, the problem to be solved in the technical field concerned is to produce in a closed or open vessel or the like a stirring or turbulent action distributed throughout the vessel in which the impeller is mounted and the medium is to be processed, with the minimum power consumption.

The various research efforts performed up to now with a view to solve this problem have been directed principally to the study of the vessel shapes and also of the impeller blade profiles, with correlative attempts to reduce through the use of suitable techniques the sometimes high cost of the vessel and blades.

Prior researches made by the Applicant proved that substantial power savings could be made when preparing a mixture by using an impeller having the best possible "pumping" (or "blowing") characteristics.

Pumping, which is the fluid flow output passing through the impeller determines the creation, in the medium receiving the impeller, of movements causing both the transport of particles constituting the medium and a distortion of the particles. This distortion, due to differential speeds, is due to the turbulent energy ($W_T$) created by the impeller, and the transport proper is due to the displacement energy ($W_D$) also created by the impeller.

The level of turbulent energy required for producing a predetermined effect is actually subordinate to this desired effect. Thus, for instance, it is easy to mix two miscible liquids, but on the other hand it is difficult to create particles of gradually decreasing magnitude in one phase dispersed in another phase.

Generally, the permissible energy savings are achieved by not exceeding the strict minimum amount of turbulent energy $W_T$ which is necessary for obtaining the desired result.

Having thus ascertained the importance of the flow output per unit of power consumption of the impeller, the Applicant directed his search more particularly towards the fluid flow patterns in the mixer vessel. This study eventually proved that a number of advantageous properties could be obtained by improving the knowledge of these flow patterns. As a rule, these improved properties led to a substantial reduction in the power consumption required for obtaining a given local effect through a better distribution of the active areas in the mixing volume, in general.

Observing the phenomena produced in a mixing vessel due to the operation of a conventional propeller proves that, in contrast to what occurs in a indefinite medium (the term "indefinite medium" denotes a liquid area not influenced by solid walls, for example in the case of a ship propeller churning sea water, in opposition to a closed vessel in which the dimensions of the vessel are small in relation to the dimensions of the impeller so that certain reflexion effects occur due to the presence of the walls) wherein the propeller jet is cylindrical, a characteristic outflaring of the jet a is produced, this jet thus assuming the shape of a more or less open cone having an apex angle $\alpha$ (see FIG. 1 of the attached drawings). This outflaring effect is subordinate to the proximity of the lateral walls and also to the viscosity of the fluid filling the vessel c. The more or less outflared configuration of the jet under given geometrical properties of the vessel and fluid viscosities may constitute an advantage, but in most instances it constitutes an inconvenience, inasmuch as the jet energy is considerably diluted therein and the local effects at points remote from the impeller may drop below a critical limit. Thus, the apex angle $\alpha$ of the cone formed by the blowing impeller may attain 120° in water if ratio d/D of the impeller diameter to the vessel diameter is 0.7 and the jet bursts out either in the bottom of the said vessel or against its vertical side wall, according to the distance from the impeller to the bottom.

Moreover, the slower the dissipation of the jet energy, the greater the distance attained by the fluid to which energy is impressed by the impeller, the dissipation being due not only to the peripheral friction forces increasing with the external surface and therefore with the outflaring, but also to the internal turbulent effects. These effects depend on the continuity of the impeller profile characteristics.

SUMMARY OF THE INVENTION

In actual practice, it is therefore very important to have the possibility, in a vessel of a given configuration of creating from the onset a conical or cylindrical jet shape of predetermined geometry and turbulence, and this constitutes the essential object of the invention.

This object is achieved according to this invention by so shaping the impeller blades that the axial effect of these blades is completed by a centrifugal or centripetal effect obtained by preserving an optimum pumping efficiency, i.e. by limiting to a minimum value the energy dissipated in the form of turbulence.

Moreover, the use of auxiliary profiles according to this invention enhances the axial or centrifugal or centripetal effect and creates in addition localized turbulences of predetermined amplitude.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

The present invention is based on the to be discussed presently theoretical principles, the understanding of which will be facilitated by the following definitions.

Figure 1:
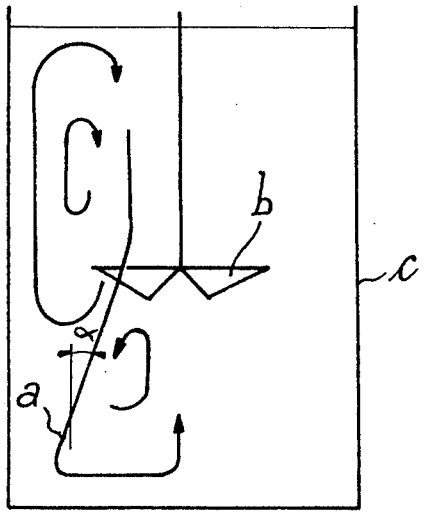
FIG. 1 is a schematic view of an impeller within a vessel.
Figure 1A:
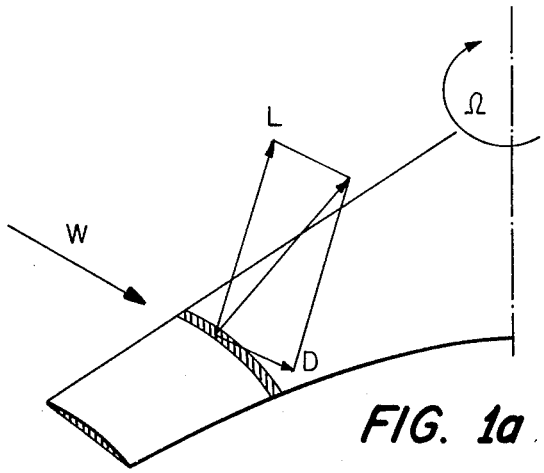
FIGS. 1*a*, 1*b* and 1*c* are schematic views of portions of impeller blades illustrating the forces involved during rotation thereof.

Lift coefficient — (See FIG. 1*a*)

When a propeller or impeller is rotating in a viscous fluid, a section of a blade of the impeller, having an area (S), located at the radius (R) reacts on the fluid with a force having two components, i.e. the lift force (L) which is perpendicular to the direction of the velocity (W) of the section relative to the fluid flow, and the drag force (D) parallel to (W). In hydrodynamics it is well known that (L) and (D) can be written as:

$$L=\tfrac{1}{2}d_m C_L S\, W^2$$
$$D=\tfrac{1}{2}d_m C_D S\, W^2$$

wherein:

$d_m$ is the fluid density;

$C_L$ is the lift coefficient;

$C_D$ is the drag coefficient; and $W^2=V^2+(\omega R)^2$, with

V=axial velocity through the propeller, and $\omega$=angular velocity of the propeller.

Figure 1B:
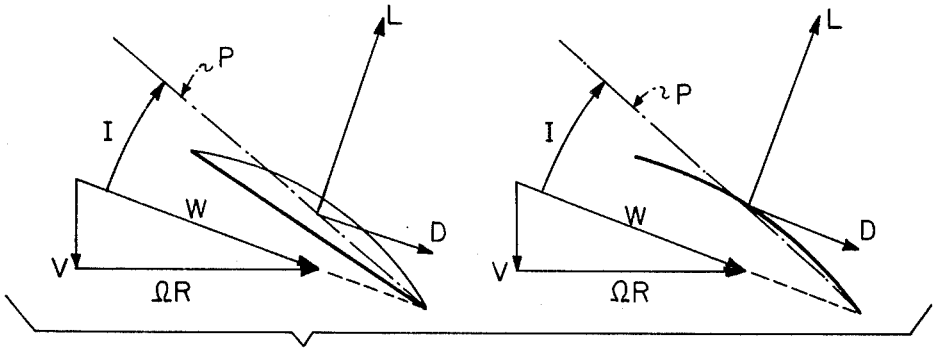

In FIG. 1*b* is indicated the angle of incidence (I) between the velocity (W) and the axis (p) for which L is equal to zero. The values of (I) and ($C_L$) are correlated for this profile as:

$$I=10\, C_L$$

Up to now, and particularly for marine type propellers, when designing the propeller the coefficient $C_L$ was chosen approximately constant. Such propellers give a very weak radial movement in an infinite volume.

It has been found that if I is chosen to increase continuously from the rotational axis to the tip, a centrifugal component of velocity appears, and the angle ($\alpha$) of the blowing cone increases.

Conversely, when I is chosen to decrease from the rotational axis up to the tip, a centripetal component appears, and angle ($\alpha$) decreases for given conditions.

This angle $\alpha$ is determined by the construction of the impeller blade, and the construction may be as follows.

The sheet metal member or plate from which the blade element e is to be made is formed to have a substantially trapezoidal contour. The major base $e_1$ of this blank is used as the blade portion located near the shaft or axis. Therefore, this portion operates at a relatively low speed but has a strong incidence in the fluid and a relatively great cross-sectional area. For opposite reasons, the minor base $e_2$ of the trapezium is adapted to constitute the external portion of the blade. The ratio of the major base to the minor base is selected according to the area preferred for the maximum flow intensity.

Figure 2A:
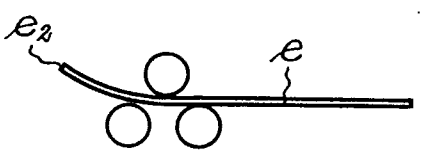
FIGS. 2*a* and 3*a* are end views of the arrangements of FIGS. 2 and 3, respectively.
Figure 3A:
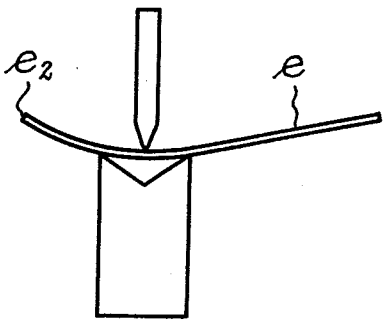
Figure 2:
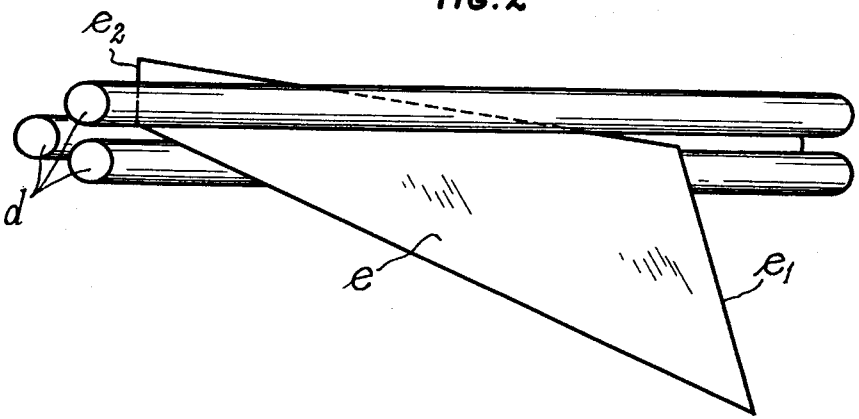
FIGS. 2 and 3 are perspective views of the formation of impeller blades by rolling and pressing, respectively.
Figure 3:
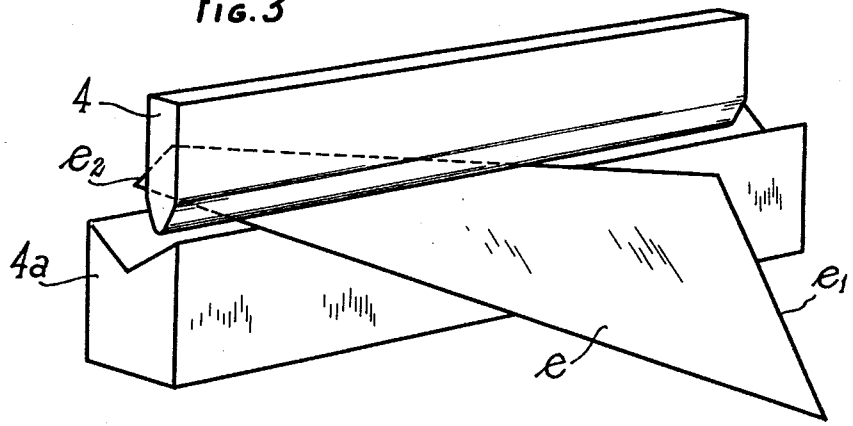

The plate thus cut is shaped either by rolling as illustrated in FIGS. 2 and 2*a*, or in a press, as illustrated in FIGS. 3 and 3*a* of the drawings, in order to impart a cylindrical or tapered configuration thereto, or a compound shape by combining cylindrical, conical and/or flat portions.

Figure 1C:
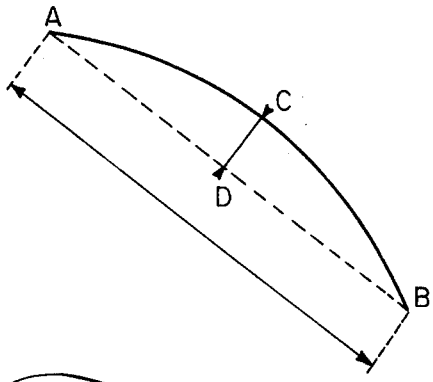
Figure 1D:
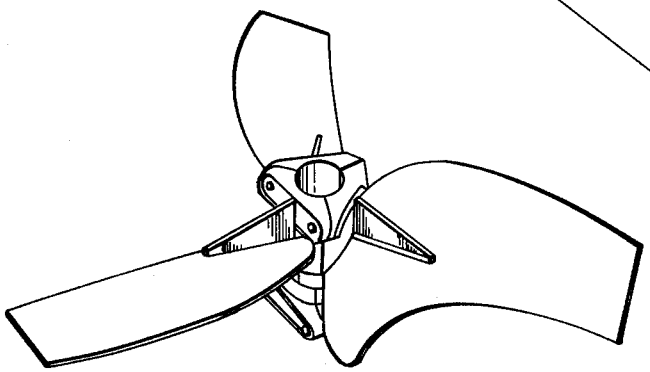
FIG. 1*d* is a perspective view of an impeller according to the invention.

The variation in the lift coefficient $C_L$ is obtained by varying both the angle of incidence of the fluid (medium) on the average chord of the profile, and the relative sag i.e. the ratio CD/AB as indicated in FIG. 1*c*.

The most advantageous positions for mixing operations are as a rule and according to this invention those wherein the section AB of FIG. 1*c* is either circular or elliptical with a relative sag i.e. ratio CD/AB, between 2% and 12%, and blade incidence angles i.e. angle (I), between 3° and 10°, whereby $C_L$ values of from 0.7 to 1.6 for a-10-degree incidence and a 12% relative are obtained.

Figure 4:
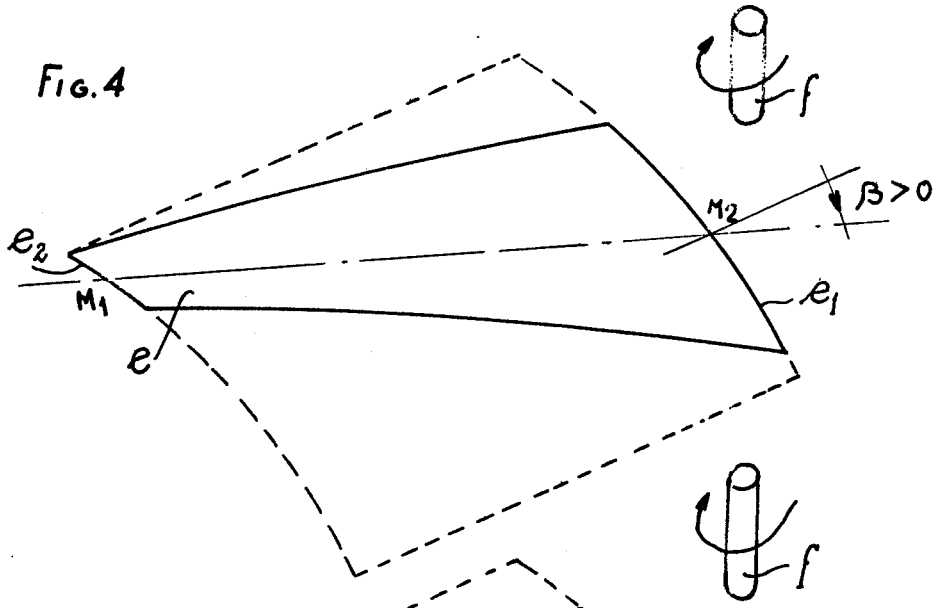
FIGS. 4 through 6 are perspective schematic views illustrating various impeller blade configurations.

According to this invention and to a typical embodiment thereof, in which the blades are obtained by cylindrical circular rolling between the rollers d of FIG. 2, in a first case illustrated in FIG. 4 the minor base $e_2$ is engaged first into the nip formed by rollers d or similarly between the V-sectioned bending tools 4, 4*a* of a bending press of FIG. 3.

Thus, the angle $\hat{\beta}$ formed between the roller generatrix and the center line $M_1 M_2$ of blade e is directed as shown by the arrow in FIG. 4, and will be referred to as a positive angle.

Therefore, the incidence of the blade section chord decreases as the distance from the rotational axis f increases, and the lift coefficient $C_L$ increases accordingly. Therefore, this blade has a centripetal corrective component with respect to the fluid jet, which tends to reduce the blowing cone angle of the impeller, the term "blowing" having the same meaning as "pumping" but being employed more particularly when the impeller pumps the fluid downwardly.

Figure 6:
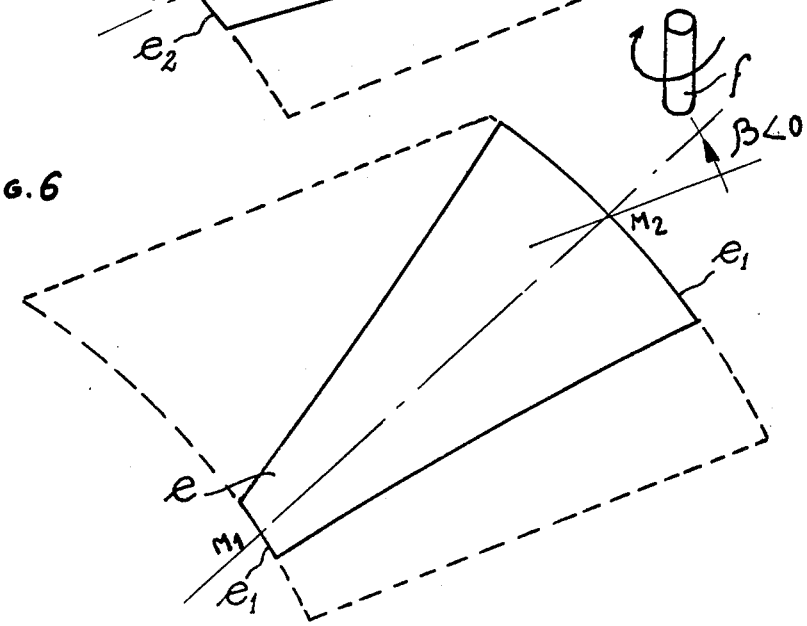

Conversely, when as in the case illustrated in FIG. 6 the major base of the trapezium is engaged first, $\hat{\beta}$ will be "negative", and the blade chord incidence will increase from the axis of rotation of the impeller to the outer periphery thereof, so that the $C_L$ and the blade correction will be centrifugal, thus resulting in an increase or opening of the blowing cone angle.

By way of example, when the ratio d/D of the impeller diameter to the vessel diameter approximates 0.5 with a 1-centipoise viscosity and a given value (approximating 20°) of the positive angle $\hat{\beta}$, movable blades producing a purely axial flow are obtained, the blowing volume having in this case a cylindrical pattern.

Figure 5:
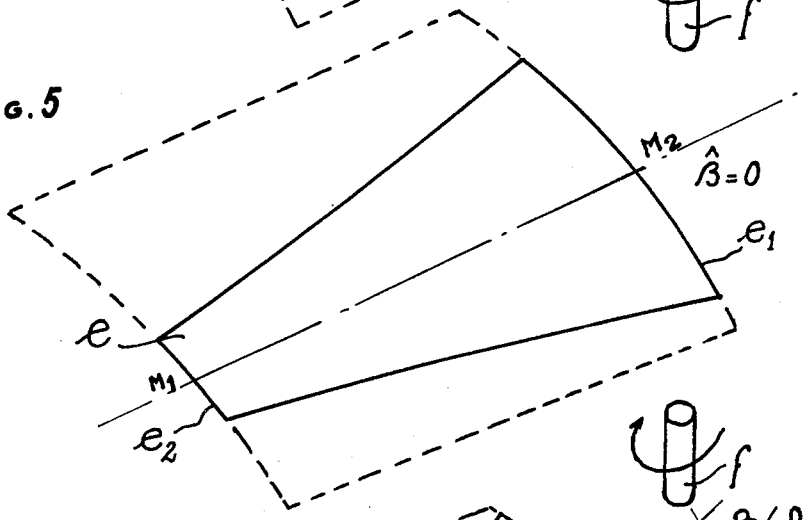

When, as illustrated in FIG. 5, $\hat{\beta}$ is zero, the conical flow is characteristic and the angle $\hat{\alpha}$ of FIG. 1 has a value close to 45° under the same conditions.

Figure 7:
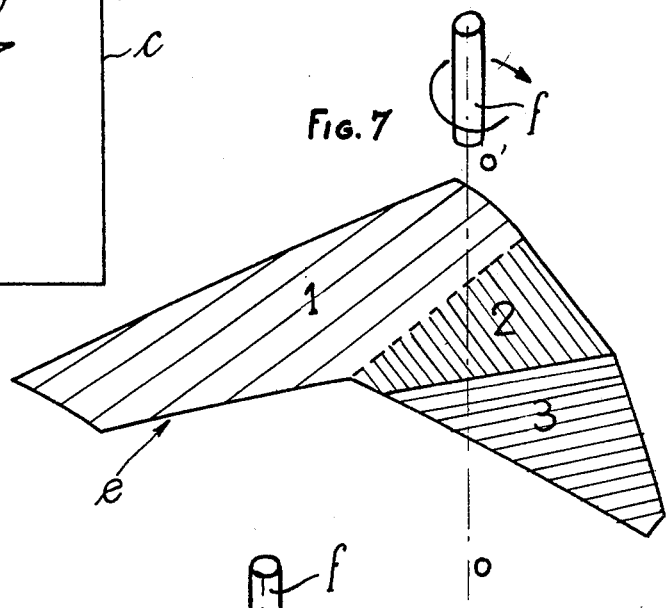
FIGS. 7 and 8 are perspective views of compound configurations of impeller blades.
Figure 8:
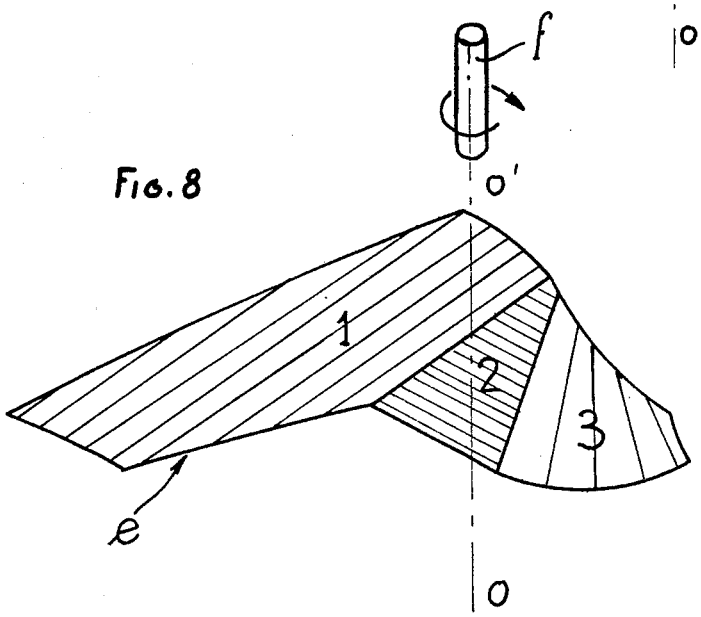

Another exemplary embodiment is illustrated in FIGS. 7 and 8. In this case the blade has been given a compound cylindrical -plano-conical shape. In FIGS. 7 and 8, the area 1 is cylindrical as in the preceding example.

The area 2 is flat, either tangent to the preceding cylindrical area 1 (FIG. 7) or bent along this tangent (FIG. 8). The next area 3 is cylindrical in FIG. 7 and corresponds to a definitely centrifugal helix. Area 3 is tapered in FIG. 8 which is clearly centripetal.

In this case the corrective effect is due to the fact that the sag and the incidence, and therefore also the $C_L$ thereof, increase from the axis to the outer periphery of the blade in the case illustrated in FIG. 7, and decrease in the case of FIG. 8.

Auxiliary flaps may also be added to the improved impellers of this invention without departing from the basic principles of the invention. These auxiliary flaps consist of profiles designed and calculated with a view to obtain a well-defined and desired result. They are constructed like the main blades from plate blanks and are roller-shaped or pressed. If desired, they can be disposed to constitute either extensions or projections on the lower and/or upper surfaces of the main blades.

These auxiliary flaps may serve the purpose of either simply enhancing an axial or centrifugal or centripetal effect, or developing an eddy area of predetermined intensity and location.

FIGS. 9 to 13 of the attached drawings illustrate diagrammatically by way of example, not of limitation, several embodiments of these auxiliary flaps.

Figures 9, 10, 11, 12, 13:
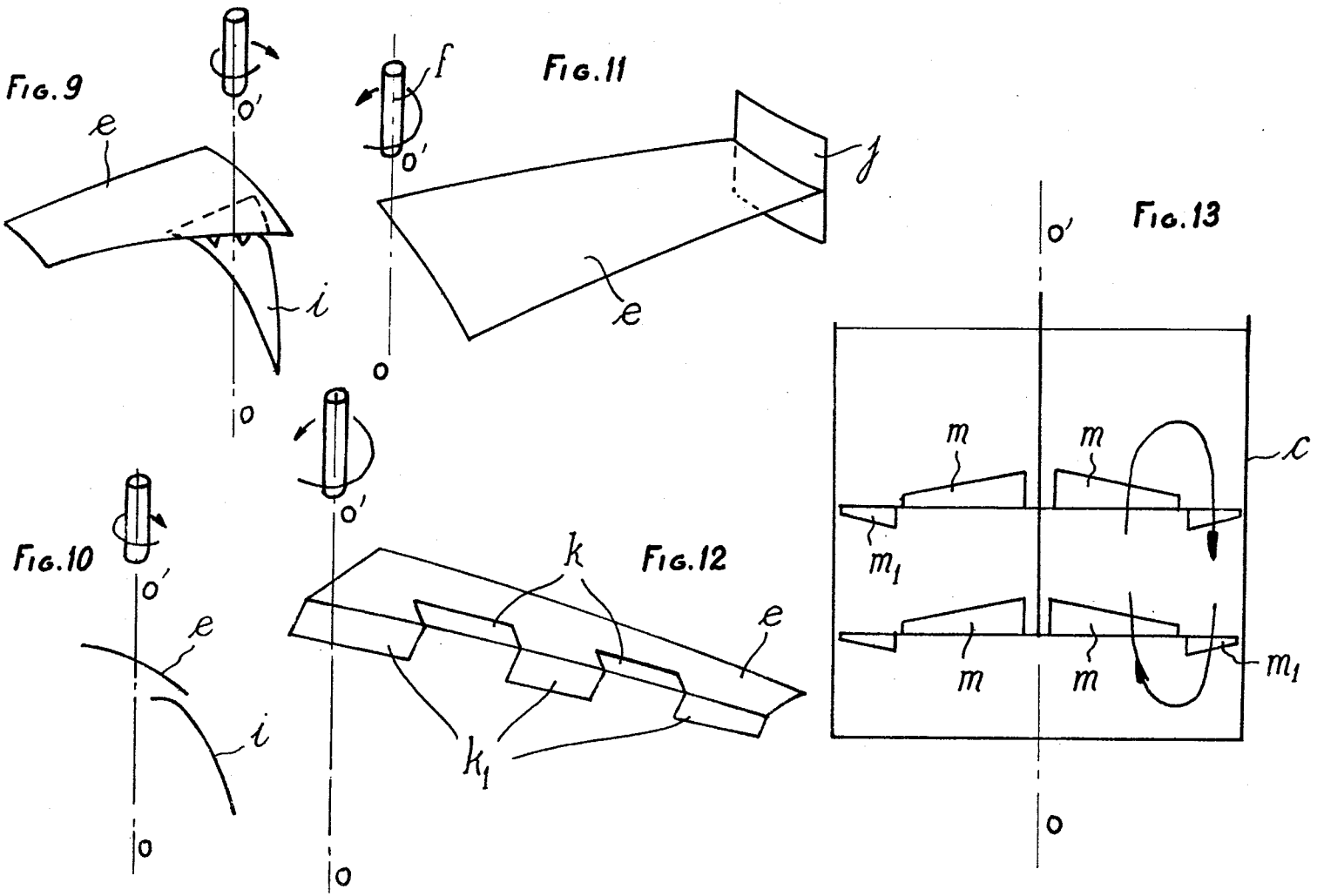
FIGS. 9 and 10 are a perspective view and an end view, respectively, of an impeller blade having one type of an auxiliary flap.
FIGS. 11 through 13 are schematic views of further auxiliary flap configurations.

In FIG. 9 the flaps are similar to the ailerons currently added to aircraft wings for modifying the lift thereof.

In the case of FIGS. 9 and 10, the flap i is secured for instance to the lower surface of the blade e and its axis intersects that of the blade e so as to produce a centripetal action. Flap i could as well constitute an extension of blade e.

In FIG. 11, the desired effect is centrifugal. The flap j is secured to the outer tip of the blade, it has a vertical cylindrical circular configuration, it projects from both the lower and upper surfaces of the blade, and its total height corresponds to the chord of the main blade, at 0.7 of its radius. The desired result may be inverted, for example by using a concave flap instead of a convex flap, as seen by an observer standing at the impeller axis. Finally, FIG. 12 illustrates a particularly simple embodiment in which the main blade e consists of a possibly flat member to which flat or curved elements k disposed or bent in one direction are secured in one section, the next section comprising similar elements $k_1$ but disposed in the opposite direction.

If the total lift of the elements bent in one direction is equal to the lift of the elements bent in the opposite direction, and if the lengths of each section are relatively moderate, the whole of the complmentary energy absorbed by these elements is converted into turbulence. Of course, the bent elements may be located either along the trailing edge as shown or along the leading edge, or possibly along both edges simultaneously.

A specific arrangement illustrated in FIG. 13 comprises the use of only two sets of elements m, $m_1$ bent in opposite directions. If the total lift thus obtained is zero, then equal flows, i.e. a central flow and a peripheral flow, are obtained.

This specific arrangement is particularly advantageous when non-newtonian fluids are to be mixed together, for, in contrast to all other impellers, the assembly illustrated in FIG. 13 and described hereinabove occupies the entire cross-sectional area of the mixing vessel, whereby the peripheral dead area possibly resulting from the existence of a mixed fluid shearing threshold is eliminated.

Of course, this invention should not be construed as being strictly limited by the specific embodiments described, illustrated and suggested herein, since various modifications and variations may be made thereto without departing from the basic principles of the invention as set forth in the appended claims.

What I claim is:

1. An axial flow bladed impeller intended for exerting a stirring action in a fluid medium, the primary phase of which is liquid, contained in a vessel designed such that the configuration of the blowing zone can be forecast and calculated in order to optimize the efficiency of the mixing effect, by the action of generally centripetal secondary radial currents, said impeller having a rotational axis and plural blades spaced therearound, each said blade being formed of a trapezoidal sheet of material such that said blade has a constant thickness, each said blade having a leading edge and a trailing edge, taken in the direction of rotation of said impeller, all sections of each said blade formed at positions radially spaced from said rotational axis being curved, the distance between said leading edge and said trailing edge of each said blade continuously decreasing from said rotational axis to the outer blade tip, and for any given said section of each said blade there being an angle of incidence defined between a velocity vector of the fluid flow acting on said section and a straight line extending from said trailing edge of said section to a point on said section whereat a tangent to said section is parallel to said velocity vector, said angle of incidence for each said blade continuously varying and generally decreasing from said rotational axis to said outer blade tip.

2. A propeller as claimed in claim 1, wherein for each said blade, the ratio of CD/AB is between 2% and 10%, wherein AB is the length of a straight line between said leading and trailing edges, and wherein CD is the greatest length between the upper surface of said blade and said straight line taken perpendicular to said straight line; said angle of incidence is between 3° and 10°.

3. A propeller as claimed in claim 2, further comprising auxiliary flap means attached to said blades for reinforcing axial and radial forces produced by said blades and for increasing the turbulence created by said propeller.

4. A propeller as claimed in claim 3, wherein said auxiliary flap means comprise ailerons disposed as extensions of the upper and lower surfaces of the blade.

5. A propeller as claimed in claim 3, wherein said auxiliary flap means comprise a plurality of complementary elements, arranged along the trailing edges of the blades and alternately projecting from the lower surface and from the upper surface of each blade.

6. A propeller as claimed in claim 3, wherein said auxiliary flap means comprises two sections of elements bent in opposite directions to form means for providing a zero total lift and for forming an impeller producing a central flow and a peripheral flow which are opposed and equal.

* * * * *